US010508825B2

(12) United States Patent
Liang et al.

(10) Patent No.: US 10,508,825 B2
(45) Date of Patent: Dec. 17, 2019

(54) SOLAR AIR CONDITIONER, METHOD AND DEVICE FOR CONTROLLING SOLAR AIR CONDITIONER

(71) Applicant: MIDEA GROUP CO., LTD., Foshan, Guangdong (CN)

(72) Inventors: Minyou Liang, Guangdong (CN); Dongpei Bai, Guangdong (CN); Hongtao Li, Guangdong (CN)

(73) Assignee: MIDEA GROUP CO., LTD., Foshan (CN)

( * ) Notice: Subject to any disclaimer, the term of this patent is extended or adjusted under 35 U.S.C. 154(b) by 466 days.

(21) Appl. No.: 15/106,837

(22) PCT Filed: Sep. 24, 2014

(86) PCT No.: PCT/CN2014/087289
§ 371 (c)(1),
(2) Date: Jun. 21, 2016

(87) PCT Pub. No.: WO2015/161623
PCT Pub. Date: Oct. 29, 2015

(65) Prior Publication Data

US 2017/0191694 A1 Jul. 6, 2017

(30) Foreign Application Priority Data

Apr. 22, 2014 (CN) ..... 2014 1 0164000

(51) Int. Cl.
*F24F 11/89* (2018.01)
*F25B 27/00* (2006.01)
(Continued)

(52) U.S. Cl.
CPC ..... *F24F 11/89* (2018.01); *F24F 5/0046* (2013.01); *F25B 27/00* (2013.01); *F25B 27/005* (2013.01);
(Continued)

(58) Field of Classification Search
CPC ..... F24F 2011/002; F24F 2005/0067; F25B 27/005; F25B 2600/024; F25B 2700/171
(Continued)

(56) References Cited

U.S. PATENT DOCUMENTS 5,560,218 A * 10/1996 Jang ..... F25B 49/025 323/906
5,878,584 A * 3/1999 Sasaki ..... F24F 5/0046 307/22
(Continued)

FOREIGN PATENT DOCUMENTS

CN 201917021 U 8/2011
CN 203586455 U 5/2014
(Continued)

OTHER PUBLICATIONS

1st Office Action of counterpart Chinese Patent Application No. 201410164000.5 dated Mar. 26, 2015.
(Continued)

*Primary Examiner* — Henry T Crenshaw
(74) *Attorney, Agent, or Firm* — Anova Law Group PLLC

(57) ABSTRACT

Disclosed is a method for controlling a solar air conditioner, which includes: a detection step, detecting the change situation of a DC voltage outputted by an inverter of the solar air conditioner when it is detected that the solar air conditioner enters an energy-saving control mode; and a judging step, adjusting an operating frequency of a compressor of the solar air conditioner according to the change situation of the DC voltage, so that the solar air conditioner uses a solar cell to supply power. Thus, solar energy can be used to the maximum degree, the problem that there is a need to supply power by a mains power supply because the power supplied for the solar energy is insufficient is avoided, and the cost is
(Continued)

saved. Further a device for controlling the solar air conditioner and the solar air conditioner are provided.

18 Claims, 8 Drawing Sheets

(51) Int. Cl.
*F24F 5/00* (2006.01)
*F24F 11/46* (2018.01)

(52) U.S. Cl.
CPC ..... *F24F 11/46* (2018.01); *F24F 2005/0064* (2013.01); *F25B 2600/021* (2013.01); *F25B 2600/025* (2013.01); *F25B 2700/15* (2013.01)

(58) Field of Classification Search
USPC ..... 62/230
See application file for complete search history.

(56) References Cited

U.S. PATENT DOCUMENTS 6,813,897 B1 * 11/2004 Bash ..... F25B 27/00 307/64
2010/0066168 A1 * 3/2010 Gamliel ..... F24F 5/0046 307/23

FOREIGN PATENT DOCUMENTS

| | | | | |
|---|---|---|---|---|
| CN | 103940045 | A | 7/2014 | |
| EP | 0748991 | A2 | 12/1996 | |
| JP | H05157330 | A | 6/1993 | |
| JP | 2005337519 | A | 12/2005 | |
| WO | 2011095020 | A1 | 8/2011 | |
| WO | WO 2011095020 | A1 * | 8/2011 | ..... H02J 7/35 |

OTHER PUBLICATIONS

2nd Office Action of counterpart Chinese Patent Application No. 201410164000.5 dated Nov. 17, 2015.

International Search Report of PCT Patent Application No. PCT/CN2014/087289 dated Jan. 27, 2015.

Extended European Search Report of counterpart European Patent Application No. 14890330.5 dated Mar. 1, 2018.

* cited by examiner

SOLAR AIR CONDITIONER, METHOD AND DEVICE FOR CONTROLLING SOLAR AIR CONDITIONER

FIELD

The present disclosure relates to the field of air conditioner technology, and in particular, to a method and a device for controlling a solar air conditioner, and the solar air conditioner.

BACKGROUND

The existed solar air conditioners have the following two technical solutions:

1. When the power supply of the solar air conditioner is insufficient, storage battery is used to power the solar air conditioner, however, mounting of the storage battery takes up space, the useful life of the storage battery is short, and the storage battery should be replaced regularly, thus the cost is high and the operation is inconvenient;

2. When the power supply of the solar air conditioner is insufficient, once the direct voltage outputted by an inverter of the solar air conditioner is below the voltage of a utility grid, the solar air conditioner is powered by the utility grid immediately, the cost and the consumption are high.

Therefore, how to operate the air conditioner system through a mode of providing power maximumly by the solar energy becomes an urgent technical problem needed to be solved.

SUMMARY

The present disclosure aims to solve one of the technical problems existed in the existed technology or the correlative technology.

So that, one object of the present disclosure is to provide a method for controlling a solar air conditioner.

Another object of the present disclosure is to provide a device for controlling the solar air conditioner.

One more object of the present disclosure is to provide a solar air conditioner.

In order to achieve the above object, an exemplary embodiment according to a first aspect of the present disclosure provides a method for controlling a solar air conditioner, which includes: a detecting step, when the solar air conditioner enters into an energy-saving control mode is detected, detecting a changing situation of a direct voltage outputted by an inverter of the solar air conditioner; and a judging step, adjusting an operating frequency of a compressor of the solar air conditioner according to the changing situation of the direct voltage, so that the solar air conditioner is powered by a solar cell.

In the method for controlling solar air conditioner according to the exemplary embodiment of the present disclosure, the situation of the direct voltage outputted by the inverter of the solar air conditioner can reflect an electricity quantity condition of the solar cell, so that, the electricity quantity condition of the solar cell can be achieved by detecting the situation of the direct voltage outputted by the inverter, the operating frequency of the compressor of the solar air conditioner can be further adjusted according to the situation of the direct voltage, thus, the solar energy can be used maximally, the solar air conditioner does not need to be powered by the mains supply.

According to an exemplary embodiment of the present disclosure, when the changing situation of the direct voltage is that the direct voltage increases, increasing the operating frequency of the compressor, when the changing situation of the direct voltage is that the direct voltage decreases, decreasing the operating frequency of the compressor.

In the method for controlling the solar air conditioner according to the exemplary embodiment of the present disclosure, when the direct voltage increases, this means that the electricity quantity of the solar cell increases, at this time, the operating frequency of the compressor can be increased, when the direct voltage decreases, this means that the electricity quantity of the solar cell decreases, at this time, in order to ensure the using of the solar cell, the operating frequency of the compressor is decreased, such that, the solar cell of the solar air conditioner is maximumly used by changing the frequency of the compressor according to the changing of the direct voltage.

According to an exemplary embodiment of the present disclosure, the control method further includes: a setting step, setting a preset voltage value according to a received setting command; and the judging step includes: when the changing situation of the outputted direct voltage is that the outputted direct voltage changes from lower than the preset voltage value to higher than the preset voltage value, increasing the operating frequency of the compressor; when the changing situation of the outputted direct voltage is that the outputted direct voltage changes from higher than the preset voltage value to lower than the preset voltage value, decreasing the operating frequency of the compressor; when the changing situation of the outputted direct voltage is that the outputted direct voltage is always higher than the preset voltage value, judging whether the operating frequency of the compressor reaches a frequency need to be decreased when the direct voltage is lower than the preset voltage, when the judgement is no, quickening up an increasing speed of the operating frequency of the compressor; when the judgement is yes, judging whether the direct voltage outputted by the inverter in the solar air conditioner increases continuously, when the judgement is yes, increasing the operating frequency of the compressor; when the judgement is no, judging whether the direct voltage outputted by the inverter in the solar air conditioner remains unchanged, when the judgement is yes, decreasing the increasing speed of the operating frequency of the compressor, when the judgement is no, that is, the direct voltage outputted by the inverter of the solar air conditioner decreases continuously, and decreasing the operating frequency of the compressor; when the changing situation of the outputted direct voltage is that the outputted direct voltage is always lower than the preset voltage value, decreasing the operating frequency of the compressor, and judging whether the direct voltage is increasing and still lower than the preset voltage value during the process of decreasing the operating frequency of the compressor, when the judgement is no, continuing to decreasing the operating operating frequency of the compressor, when the judgement is yes, increasing the operating operating frequency of the compressor. In the method for controlling the solar air conditioner according to the exemplary embodiment of the present disclosure, the preset voltage value is set, and the frequency of the compressor is controlled to be increased or decreased by comparing the direct voltage with the preset voltage value, so that the electric quantity of the solar cell can support the compressor to work normally as much as possible.

According to an exemplary embodiment of the present disclosure, which further includes: controlling the solar air conditioner to enter into the energy-saving control mode according to a received starting command; and controlling the solar air conditioner to quit the energy-saving control mode according to a received closing command.

In the method for controlling the solar air conditioner according to the exemplary embodiment of the present disclosure, user can choose to enter into the energy-saving control mode or quit the energy-saving control mode. When the solar air conditioner enters into the energy-saving control mode, the solar air conditioner starts to detect the changing situation of the direct voltage, so that the object of maximumly using the solar energy is realized, when the solar air conditioner quits from the energy-saving control mode, user uses the air conditioner normally, at this time, it does not need to detect the changing situation of the direct voltage of the inverter. So that, user chooses needed mode according to personal needs.

According to an exemplary embodiment of the present disclosure, after the solar air conditioner quits from the energy-saving control mode, judging whether the outputted direct voltage is higher than the voltage of the utility grid, when the judgement is yes, the solar air conditioner is powered by the solar energy, when the judgement is no, the solar air conditioner is powered by the utility grid. In the method for controlling the solar air conditioner according to the exemplary embodiment of the present disclosure, after the solar air conditioner quits from the energy-saving mode, user can choose the power supply method according to the changing of the outputted voltage, the flexibility of controlling is improved.

According to a second aspect of an exemplary embodiment of the present disclosure, a device for controlling a solar air conditioner is provided, which includes: a detecting unit, configured to, when the solar air conditioner enters into an energy-saving mode is detected, detect a changing situation of a direct voltage outputted by an inverter of the solar air conditioner; a judging unit, configured to adjust an operating frequency of a compressor of the solar air conditioner according to the changing situation of the direct voltage, so that the solar air conditioner is powered by a solar cell.

In the device for controlling solar air conditioner according to the exemplary embodiment of the present disclosure, the changing situation of the direct voltage outputted by the inverter of the solar air conditioner can reflect the electricity quantity condition of the solar cell, so that, the electricity quantity condition of the solar cell can be achieved by detecting the situation of the direct voltage outputted by the inverter, the operating frequency of the compressor of the solar air conditioner is further adjusted according to the situation of the direct voltage, thus, the solar energy is used maximally, the solar air conditioner do not needed to be powered by the mains supply.

According to an exemplary embodiment, adjusting the operating frequency of the compressor of the solar air conditioner according to the situation of the direct voltage includes: when the changing situation of the direct voltage is that the direct voltage increases, increasing the operating frequency of the compressor, when the changing situation of the direct voltage is that the direct voltage decreases, decreasing the operating frequency of the compressor.

In the device for controlling solar air conditioner according to the exemplary embodiment of the present disclosure, when the direct voltage increases, this means that the electricity quantity of the solar cell increases, at this time, the operating frequency of the compressor is increased, when the direct voltage decreases, this means that the electricity quantity of the solar cell decreases, at this time, in order to ensure the using of the solar cell, the operating frequency of the compressor is decreased, such that, the solar cell of the solar air conditioner is maximumly used by changing the frequency of the compressor according to the changing of the direct voltage.

According to an exemplary embodiment, further includes: a setting unit, configured to set a preset voltage value according to a received setting command; and the judging step includes: a first processing unit, configured to, when the changing situation of the outputted direct voltage is that the outputted direct voltage changes from lower than the preset voltage value to higher than the preset voltage value, increase the operating frequency of the compressor; a second processing unit, configured to, when the changing situation of the outputted direct voltage is that the outputted direct voltage changes from higher than the preset voltage value to lower than the preset voltage value, decrease the operating frequency of the compressor; a third processing unit, configured to, when the changing situation of the outputted direct voltage is that the outputted direct voltage is always higher than the preset voltage value, judge whether the operating frequency of the compressor reaches a frequency need to be decreased when the direct voltage is lower than the preset voltage, when the judgement is no, an increasing speed of the operating frequency of the compressor is quickened up; when the judgement is yes, whether the direct voltage outputted by the inverter in the solar air conditioner increases continuously is judged, when the judgement is yes, the operating frequency of the compressor is increased; when the judgement is no, whether the direct voltage outputted by the inverter in the solar air conditioner remains unchanged is judged, when the judgement is yes, the increasing speed of the operating frequency of the compressor is decreased, when the judgement is no, that is, the direct voltage outputted by the inverter in the solar air conditioner decreases continuously, and the operating frequency of the compressor is decreased; a fourth processing unit, configured to, when the changing situation of the outputted direct voltage is that the outputted direct voltage is always lower than the preset voltage value, decrease the operating frequency of the compressor, and judge whether the direct voltage is increasing and still lower than the preset voltage value during a process of the decreasing operating frequency of the compressor, when the judgement is no, the operating frequency of the compressor is continued to be decreased, when the judgement is yes, the operating frequency of the compressor is increased.

In the method for controlling the solar air conditioner according to an exemplary embodiment of the present disclosure, setting the preset voltage value, and controlling the frequency of the compressor is controlled to be increased or decreased by comparing the direct voltage with the preset voltage value, so that the electric quantity of the solar cell can support the compressor to work normally as much as possible.

According to an exemplary embodiment of the present disclosure, further includes: a starting unit, configured to control the solar air conditioner to enter into the energy-saving control mode according to a received starting command; and a closing unit, configured to control the solar air conditioner to quit from the energy-saving control mode according to a received closing command.

In the method for controlling the solar air conditioner according to an exemplary embodiment of the present disclosure, user can choose to enter into the energy-saving control mode or quit from the energy-saving control mode. When the solar air conditioner enters into the energy-saving control mode, detecting the changing situation of the direct voltage, so that the object of maximumly using the solar energy is realized, when the solar air conditioner quits from the energy-saving control mode, user uses the air conditioner normally, at this time the changing situation of the direct voltage of the inverter is not detected. So that, user chooses needed mode according to personal needs.

According to an exemplary embodiment of the present disclosure, after the solar air conditioner quits from the energy-saving control mode, judging whether the outputted direct voltage is higher than the voltage of the utility grid, when the judgement is yes, the solar air conditioner is powered by a solar energy, when the judgement is no, the solar air conditioner is powered by the utility grid.

In the device for controlling the solar air conditioner according to an exemplary embodiment of the present disclosure, after the solar air conditioner quits from the energy-saving mode, user can choose the power supply method according to the changing of the outputted voltage, the flexibility of controlling is improved.

A solar air conditioner is provided according to an exemplary embodiment of a third aspect of the present disclosure, which includes the device for controlling the solar air conditioner contained in any one of technology solutions as described above: the air conditioner has the same technical effect with the device for controlling the solar air conditioner, no need to be repeated herein.

The frequency of the compressor can be changed according to the changes of the direct voltage by the technology solutions, so that the solar cell of the solar air conditioner can be maximumly used.

BRIEF DESCRIPTION OF THE DRAWINGS

The above technical solutions or additional technical solutions, and their advantages, would become obvious and easy to understand by combining the exemplary embodiment with the drawings.

DETAILED DESCRIPTION OF THE EMBODIMENTS

In order to make the object, the features and the advantages of the present disclosure much clear, the present disclosure is further described in detail with reference to the accompanying drawings and embodiments. It is to be noted that, technical features in the embodiments and technical features in other embodiments can be combined without conflict.

The details are set forth in the accompanying description below to understand the present disclosure fully, however, the present disclosure can also be carried out by other methods different from the described description, so that, the present disclosure is not limited to such embodiments.

Figure 1:
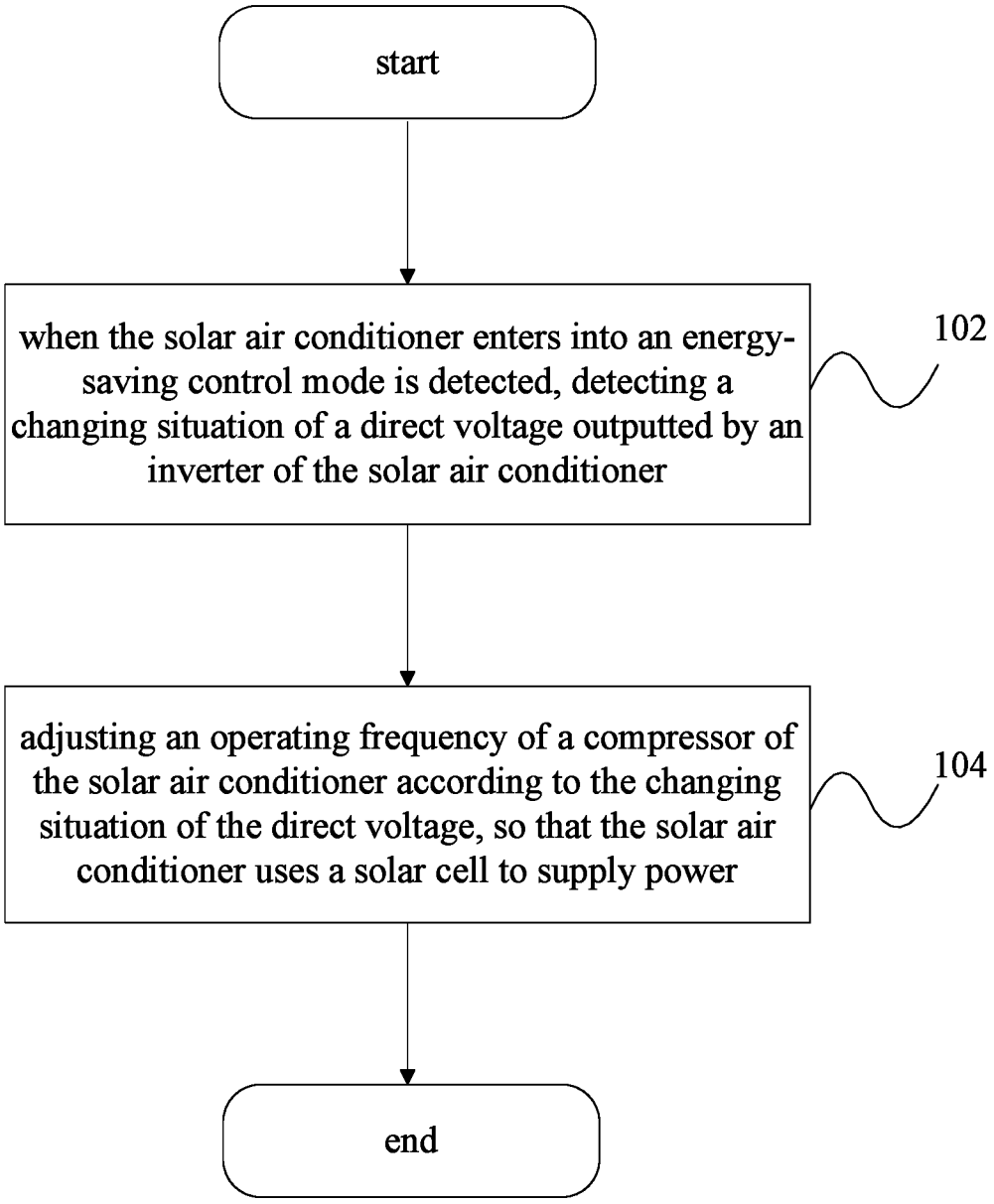
FIG. 1 is a flow chart of a method for controlling a solar air conditioner according to an exemplary embodiment of the present disclosure.

FIG. 1 shows a flow chart of a method for controlling a solar air conditioner according to an exemplary embodiment of the present disclosure.

Referring to FIG. 1, according to an exemplary embodiment, the method includes: a detecting step 102, when the solar air conditioner enters into an energy saving mode is detected, detecting a changing situation of a direct voltage outputted by an inverter in the solar air conditioner; a judging step 104, adjusting the operating frequency of a compressor of the solar air conditioner according to the changing of the direct voltage, so that the solar air conditioner can be powered by a solar cell.

In the method for controlling the solar air conditioner according to the exemplary embodiment of the present disclosure, the situation of the direct voltage outputted by the inverter of the solar air conditioner can reflect the electricity quantity condition of the solar cell, so that, the electricity quantity condition of the solar cell can be achieved by detecting the situation of the direct voltage outputted by the inverter, the operating frequency of the compressor of the solar air conditioner can be further adjusted according to the situation of the direct voltage, thus, the solar energy can be used maximally, the solar air conditioner does not needed to be powered by the mains supply.

According to an exemplary embodiment of the present disclosure, when the changing situation of the direct voltage is that the direct voltage increases, increasing the operating frequency of the compressor, when the changing situation of the direct voltage is that the direct voltage decreases, decreasing the operating frequency of the compressor.

In the method for controlling solar air conditioner according to the exemplary embodiment of the present disclosure, when the direct voltage increases, this means that the electricity quantity of the solar cell increases, at this time, the operating frequency of the compressor can be increased, when the direct voltage decreases, this means that the electricity quantity of the solar cell decreases, at this time, in order to ensure the using of the solar cell, the operating frequency of the compressor can be decreased, such that, the solar cell of the solar air conditioner can be maximumly used by changing the frequency of the compressor according to the changing of the direct voltage.

According to an exemplary embodiment of the present disclosure, before the detecting step 102, the method also includes: setting a preset voltage value according to a received setting command; and the judging step 104 includes: when the changing situation of the outputted direct voltage is that the outputted direct voltage changes from lower than the preset voltage value to higher than the preset voltage value, increasing the operating frequency of the compressor; when the changing situation of the outputted direct voltage is that the outputted direct voltage changes from higher than the preset voltage value to lower than the preset voltage value, decreasing the operating frequency of the compressor; when the changing situation of the outputted direct voltage is that the outputted direct voltage is always higher than the preset voltage value, judging that whether the operating frequency of the compressor reaches a frequency need to be decreased when the direct voltage is lower than the preset voltage, when the judgement is no, quickening up an increasing speed of the operating frequency of the compressor; when the judgement is yes, judging whether the direct voltage outputted by the inverter of the solar air conditioner increases continuously, when the judgement is yes, increasing the operating frequency of the compressor; when the judgement is no, judging whether the direct voltage outputted by the inverter in the solar air conditioner remains unchanged, when the judgement is yes, decreasing the increasing speed of the operating frequency of the compressor, when the judgement is no, that is, the direct voltage outputted by the inverter in the solar air conditioner decreases continuously, and decreasing the operating frequency of the compressor; when the changing situation of the outputted direct voltage is that the outputted direct voltage is always lower than the preset voltage value, the operating frequency of the compressor should be decreased, and judging whether the direct voltage is increasing and still lower than the preset voltage value during the decreasing process of the operating frequency of the compressor, when the judgement is no, continuing to decrease the operating frequency of the compressor, when the judgement is yes, increasing the operating frequency of the compressor.

In the method for controlling the solar air conditioner according to an exemplary embodiment of the present disclosure, the preset voltage value is set, and the frequency of the compressor can be controlled to be increased or decreased by comparing the direct voltage with the preset voltage value, so that the electric quantity of the solar cell can support the compressor to work normally as much as possible.

According to an exemplary embodiment of the present disclosure, the method further includes: controlling the solar air conditioner to enter into the energy-saving control mode according to a received starting command; and controlling the solar air conditioner to quit from the energy-saving control mode according to a received closing command.

In the method for controlling the solar air conditioner according to the exemplary embodiment of the present disclosure, user can choose to enter into the energy-saving control mode or quit from the energy-saving control mode. When the solar air conditioner enters into the energy-saving control mode, the changing situation of the direct voltage is detected, so that the object of maximumly using the solar energy can be realized, when the solar air conditioner quits from the energy-saving control mode, user can use the air conditioner normally, at this time, it does not need to detect the changing situation of the direct voltage of the inverter is not detected. So that, user can choose needed mode according to personal needs.

According to an exemplary embodiment of the present disclosure, after the solar air conditioner quits from the energy-saving mode, judging whether the outputted direct voltage is higher than the voltage of the utility grid, when the judgement is yes, the solar air conditioner is powered by the solar energy, when the judgement is no, the solar air conditioner is powered by the utility grid.

In the method for controlling solar air conditioner according to the exemplary embodiment of the present disclosure, after the solar air conditioner quits from the energy-saving mode, the solar air conditioner can choose the power method according to the changing of the outputted voltage, the flexibility of controlling is improved.

Figure 2:
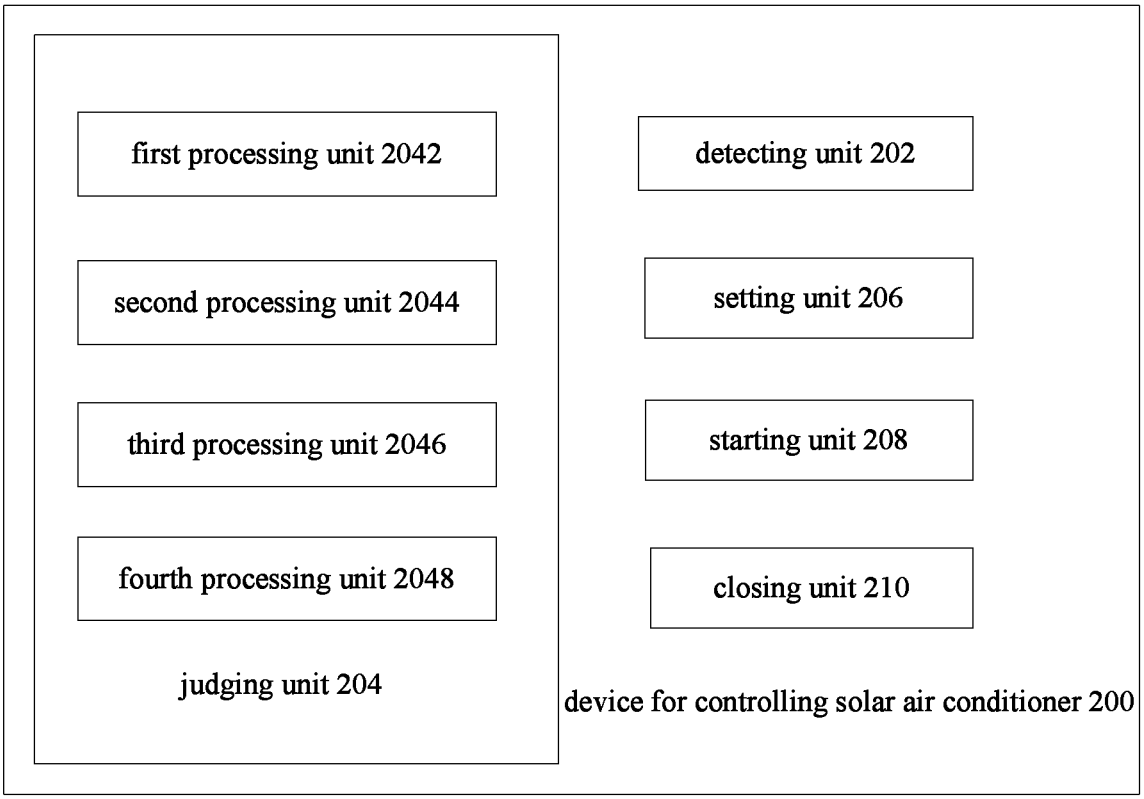
FIG. 2 is a block diagram of a device for controlling the solar air conditioner according to an exemplary embodiment of the present disclosure.

FIG. 2 shows a block diagram of a device for controlling the solar air conditioner according to an exemplary embodiment of the present disclosure.

Referring to FIG. 2, the device 200 for controlling the solar air conditioner according to an exemplary embodiment, includes: a detecting unit 202, configured to, when the solar air conditioner enters into the energy-saving mode is detected, detect the changing situation of the direct voltage outputted by the inverter in the solar air conditioner; a judging unit 204, configured to adjust the operating frequency of the compressor of the solar air conditioner according to the changing situation of the direct voltage, so that the solar air conditioner can be powered by the solar cell.

In the device for controlling the solar air conditioner according to an exemplary embodiment, the situation of the direct voltage outputted by the inverter of the solar air conditioner can reflect the electricity conditioner of the solar cell, so that, the electricity conditioner of the solar cell can be achieved by detecting the situation of the direct voltage outputted by the inverter, the operating frequency of the compressor of the solar air conditioner can be further adjusted according to the situation of the direct voltage, thus, the solar energy can be used maximally, the solar air conditioner does not needed to be powered by the mains supply.

According to an exemplary embodiment of the present disclosure, adjusting the operating frequency of the compressor of the solar air conditioner according to the changing situation of the direct voltage includes: when the changing situation of the direct voltage is that the direct voltage increases, increasing the operating frequency of the compressor, when the changing situation of the direct voltage is that the direct voltage decreases, decreasing the operating frequency of the compressor.

In the device for controlling the solar air conditioner according to an exemplary embodiment of the present disclosure, when the direct voltage increases, this means that the electricity quantity of the solar cell increases, at this time, the operating frequency of the compressor can be increased, when the direct voltage decreases, this means that the electricity quantity of the solar cell decreases, at this time, in order to ensure the using of the solar cell, the operating frequency of the compressor can be decreased, such that, the solar cell of the solar air conditioner can be maximumly used by changing the frequency of the compressor according to the changing of the direct voltage.

According to an exemplary embodiment of the present disclosure, the device further includes: a setting unit 206, configured to set a preset voltage value according to a received setting command; and the judging unit 204 includes: a first processing unit 2042, configured to, when the changing situation of the outputted direct voltage is that the outputted direct voltage changes from lower than the preset voltage value to higher than the preset voltage value, increase the operating frequency of the compressor; a second processing unit 2044, configured to, when the changing situation of the outputted direct voltage is that the outputted direct voltage changes from higher than the preset voltage value to lower than the preset voltage value, decrease the operating frequency of the compressor; a third processing unit 2046, configured to, when the changing situation of the outputted direct voltage is that the outputted direct voltage is always higher than the preset voltage value, judge that whether the operating frequency of the compressor reaches a frequency need to be decreased when the direct voltage is lower than the preset voltage, when the judgement is no, an increasing speed of the operating frequency of the compressor should be quickened up; when the judgement is yes, whether the direct voltage outputted by the inverter in the solar air conditioner increases continuously should be judged, when the judgement is yes, the operating frequency of the compressor should be increased; when the judgement is no, whether the direct voltage outputted by the inverter in the solar air conditioner remains unchanged should be judged, when the judgement is yes, the increasing speed of the operating frequency of the compressor should be decreased, when the judgement is no, that is, the direct voltage outputted by the inverter in the solar air conditioner decreases continuously, and the operating frequency of the compressor should be decreased; a fourth processing unit 2048, configured to, when the changing situation of the outputted direct voltage is that the outputted direct voltage is always lower than the preset voltage value, decrease the operating frequency of the compressor, and judge that whether the direct voltage is increasing and still lower than the preset voltage value during the process of decreasing the operating frequency of the compressor, when the judgement is no, the operating frequency of the compressor continues to be decreased, when the judgement is yes, the operating frequency of the compressor should be increased.

In the method for controlling the solar air conditioner according to the exemplary embodiment of the present disclosure, setting the preset voltage valuet, and controlling the frequency of the compressor to be increased or decreased by comparing the direct voltage with the preset voltage value, so that the electric quantity of the solar cell can support the compressor to work normally as much as possible.

According to an exemplary embodiment, the device further includes: a starting unit 208, configured to control the solar air conditioner to enter into the energy-saving control mode according to a received starting command; a closing unit 210, configured to control the solar air conditioner to quit from the energy-saving control mode according to a received closing command.

In the method for controlling the solar air conditioner according to an exemplary embodiment of the present disclosure, user can choose to enter into the energy-saving control mode or quit from the energy-saving control mode. When the solar air conditioner enters into the energy-saving control mode, detecting the changing situation of the direct voltage, so that the object of maximumly using the solar energy can be realized, when the solar air conditioner quits from the energy-saving control mode, user can use the air conditioner normally, at this time, it does not need to detect the changing situation of the direct voltage of the inverter. So that, user can choose needed mode according to personal needs.

According to an exemplary embodiment of the present disclosure, after the solar air conditioner quits from the energy-saving control mode, whether the outputted direct voltage is higher than the voltage of the utility grid is judged, when the judgement is yes, the solar air conditioner is powered by the solar energy, when the judgement is no, the solar air conditioner is powered by the utility grid.

In the device for controlling the solar air conditioner according to an exemplary embodiment of the present disclosure, after the solar air conditioner quits from the energy-saving mode, the solar air conditioner can choose the power supply method according to the changing of the outputted voltage, the flexibility of controlling is improved.

Figure 3:
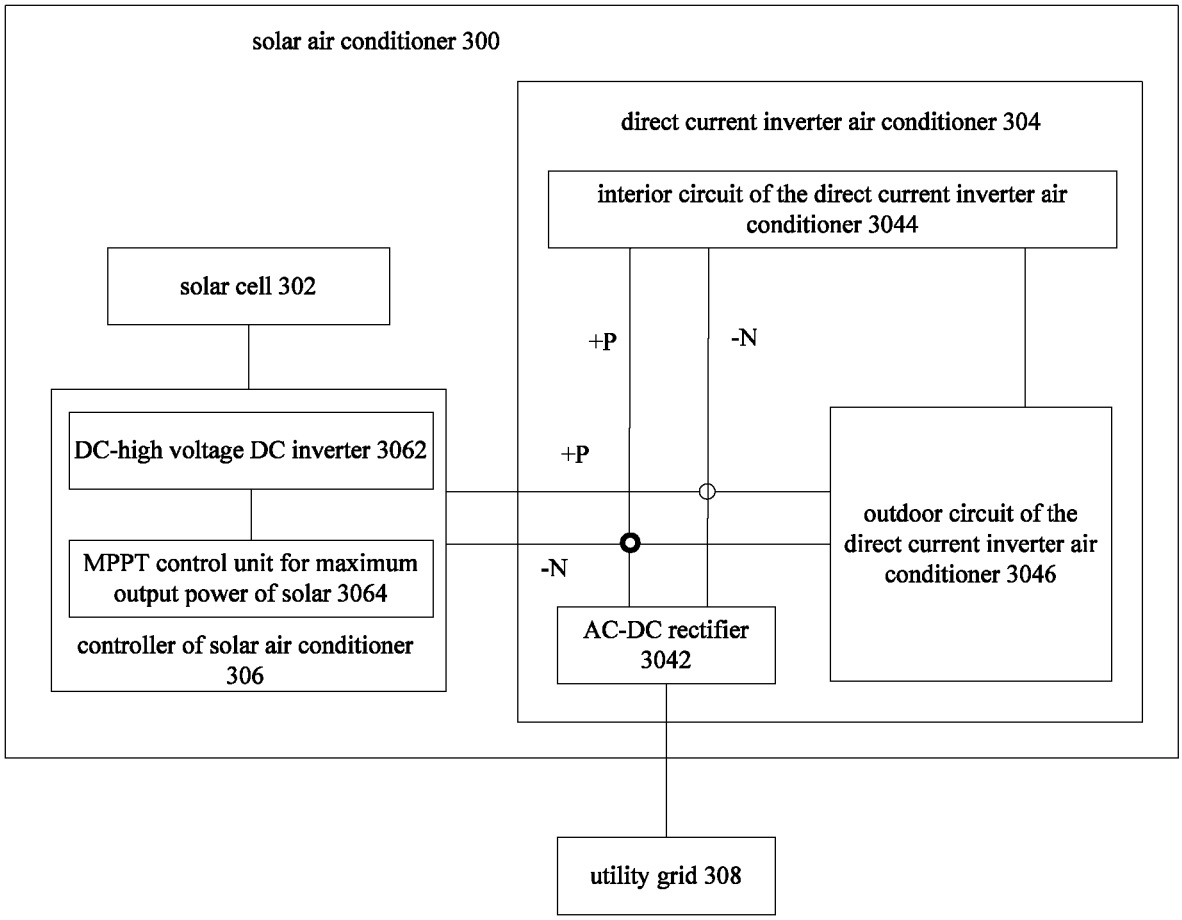
FIG. 3 is a block diagram of the solar air conditioner according to an exemplary embodiment of the present disclosure.

FIG. 3 shows a block diagram of the solar air conditioner according to an exemplary embodiment of the present disclosure.

Referring to FIG. 3, the solar air conditioner 300 according to an exemplary embodiment, includes: a solar cell 302, a direct current inverter air conditioner 304, a solar power controller 306 connected between the solar cell 302 and the direct current inverter air conditioner 304, and a utility grid 308. The direct current inverter air conditioner 304 includes an AC-DC rectifier 3042, an interior circuit of the direct current inverter air conditioner 3044 and an outdoor circuit of the direct current inverter air conditioner 3046; the interior circuit of the direct current inverter air conditioner 3044 includes a main control MCU, a switching power supply, an interior EMC circuit, a display unit, a direct current fan, a communication unit, a temperature sensor, and other functional units; the direct current inverter air conditioner 3046 includes a main control MCU, a switching power supply, a communication unit, a direct current fan, a temperature sensor, an inverter controlling and driving unit, an inverter compressor, and other functional units. The solar power controller 306 includes a DC-high voltage DC inverter 3062 and a MPPT control unit for maximum output power of solar 3064; the MPPT control unit for maximum output power of solar 3064 monitors the output power of the solar cell, and controls the DC-high voltage DC inverter 3062 to transfer low voltage direct current outputted by the solar cell to high voltage direct current, and powers the direct current inverter air conditioner 304 directly.

In order to avoid a situation of disable from driving the air conditioner caused by insufficient power outputted by the solar cell (mainly without the solar energy), a utility grid 308 is added. After the utility grid 308 passes through the AC-DC rectifier 3042, the utility grid 308 can be parallel with the solar power controller 306 to power the direct current inverter air conditioner 3046. When a direct voltage outputted by the DC-high voltage DC inverter 3062 in the solar power controller 306 is higher than a direct voltage of the utility grid 308 rectified by the AC-DC rectifier 3042, the solar cell 302 powers the direct current inverter air conditioner 3046, or the utility grid 308 powers the direct current inverter air conditioner 3046.

The present disclosure specially adds a energy-saving control function according to the features of the solar air conditioner system. The function can be set by user through an air conditioning remote control, a mobile phone application software, a computer network terminal software. After user starts the energy-saving control function, the direct current inverter air conditioner 3044 receives an ECO command sent out by the air conditioning remote control, the mobile phone application software, the computer network terminal software, and the direct current inverter air conditioner 3044 sends the energy-saving control command to the direct current inverter air conditioner 3046 through indoor and outdoor communication circuits. After the direct current inverter air conditioner 3046 receives the command, the direct current inverter air conditioner 3046 operates the energy-saving control mode. In the mode, when the solar cell 302 cannot supply enough power, the air conditioner system can change the operating frequency of the compressor, and adjust the power supply needed by the air conditioner through increasing the frequency or decreasing the frequency, the air conditioner does not need to be powered by mains supply, to maximumly use the solar.

Figure 4:
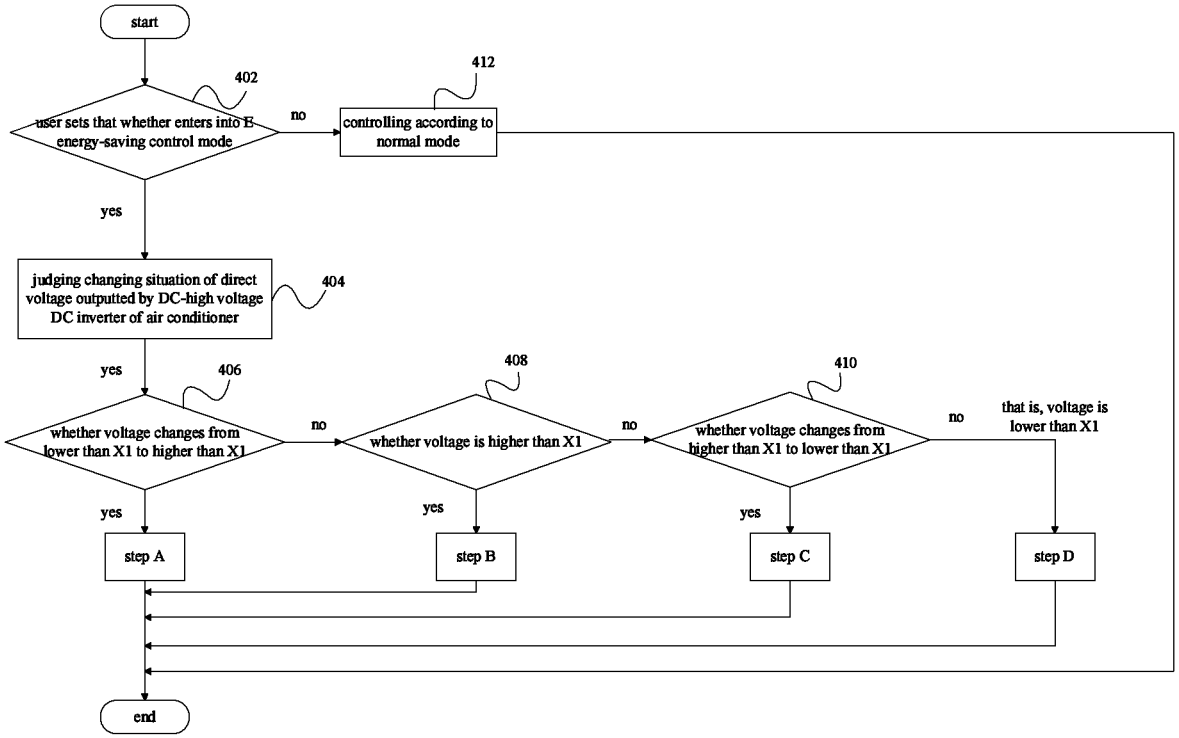
FIG. 4 is a flow chart of a method for controlling the solar air conditioner according to an exemplary embodiment of the present disclosure.

FIG. 4 is a flow chart of a method for controlling the solar air conditioner according to an exemplary embodiment of the present disclosure.

Referring to FIG. 4, the method for controlling the solar air conditioner according to an exemplary embodiment of the present disclosure, includes:

Step 402, judging whether the solar air conditioner enters into a saving controlling mode, when the judgment is yes, go to step 404, when the judgment is no, go to step 412. And, after the user starts the air conditioner, user can start the energy-saving controlling mode through the air conditioner remote control, application software of mobile phone, network terminal software of computer, and so on, the direct current inverter air conditioner 3046 starts the compressor, the compressor starts and operates, when the frequency of the compressor increases, the power needed by the air conditioner increases, after the power increases, as the power supplied by the solar cell cannot support the requirement of increasing the power, so that, the direct current voltage outputted by the DC-high voltage DC inverter decreases, if the direct current voltage outputted by the DC-high voltage DC inverter is lower than the rectified voltage of the utility grid, the air conditioner is powered by the utility grid immediately. If the air conditioner is powered by the utility grid, the energy-saving advantage of the solar energy cannot be reflected. So that, in order to maximumly use the solar energy and let the air conditioner to operate at a higher frequency band simultaneously, the changes of the DC voltage outputted by the DC-high voltage DC inverter 3 needs to be tracked rapidly, the frequency of the compressor can be changed according to the changes of the voltage, so that, the frequency can be decreased when the solar energy is insufficient, and the frequency can be increased when the solar energy is sufficient.

Step 404, judging the changing situation of the direct current voltage outputted by the DC-high voltage DC inverter of the air conditioner.

Step 406, judging whether the changing situation of the direct current voltage changes from lower than the preset voltage value X1 to higher than the preset voltage value X1, when the judgement is yes, go to step A; when the judgement is no, go to step 408.

Step 408, judging whether the direct current voltage is always higher than the preset voltage value X1, when the judgement is yes, go to step B; when the judgement is no, go to step 410.

Step 410, judging whether the changing situation of the direct current voltage changes from higher than the preset voltage value X1 to than lower the preset voltage value X1, when the judgement is yes, go to step C; when the judgement is no, that is, the direct current voltage is lower than the preset voltage value X1, go to step D.

Step 412, controlling the air conditioner to operate according to the normal mode.

Figure 5:
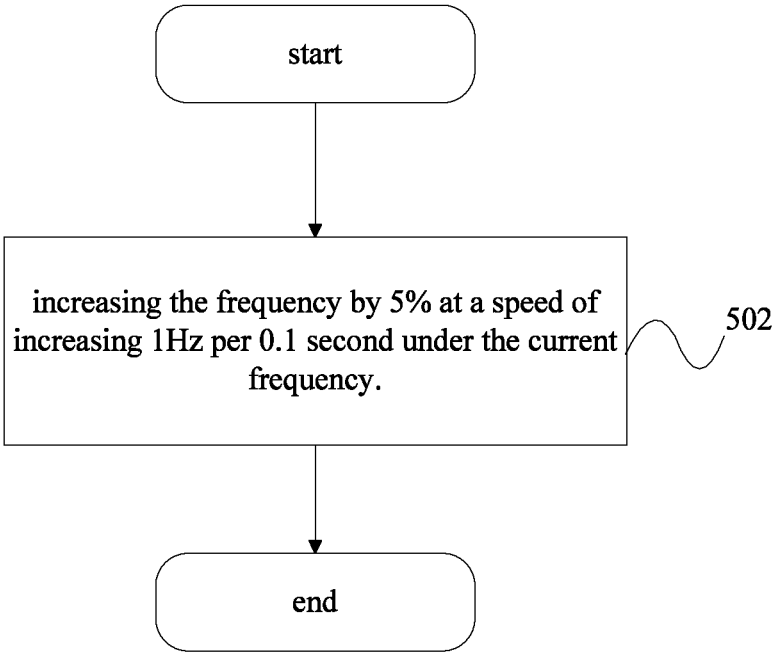
FIG. 5 is a detailed flow chart of step A of the method for controlling the solar air conditioner shown in FIG. 4.

The step A, step B, step C and step D are specifically described as follows:

FIG. 5 shows a detailed flow chart of step A of an exemplary embodiment of the present disclosure.

Referring to FIG. 5, the detailed flow of the step A includes:

Step 502: increasing the operating frequency of the compressor according to a first increasing speed, such as, the frequency is increased by 5% at a speed of increasing 1 Hz per 0.1 second under the current frequency.

Figure 6:
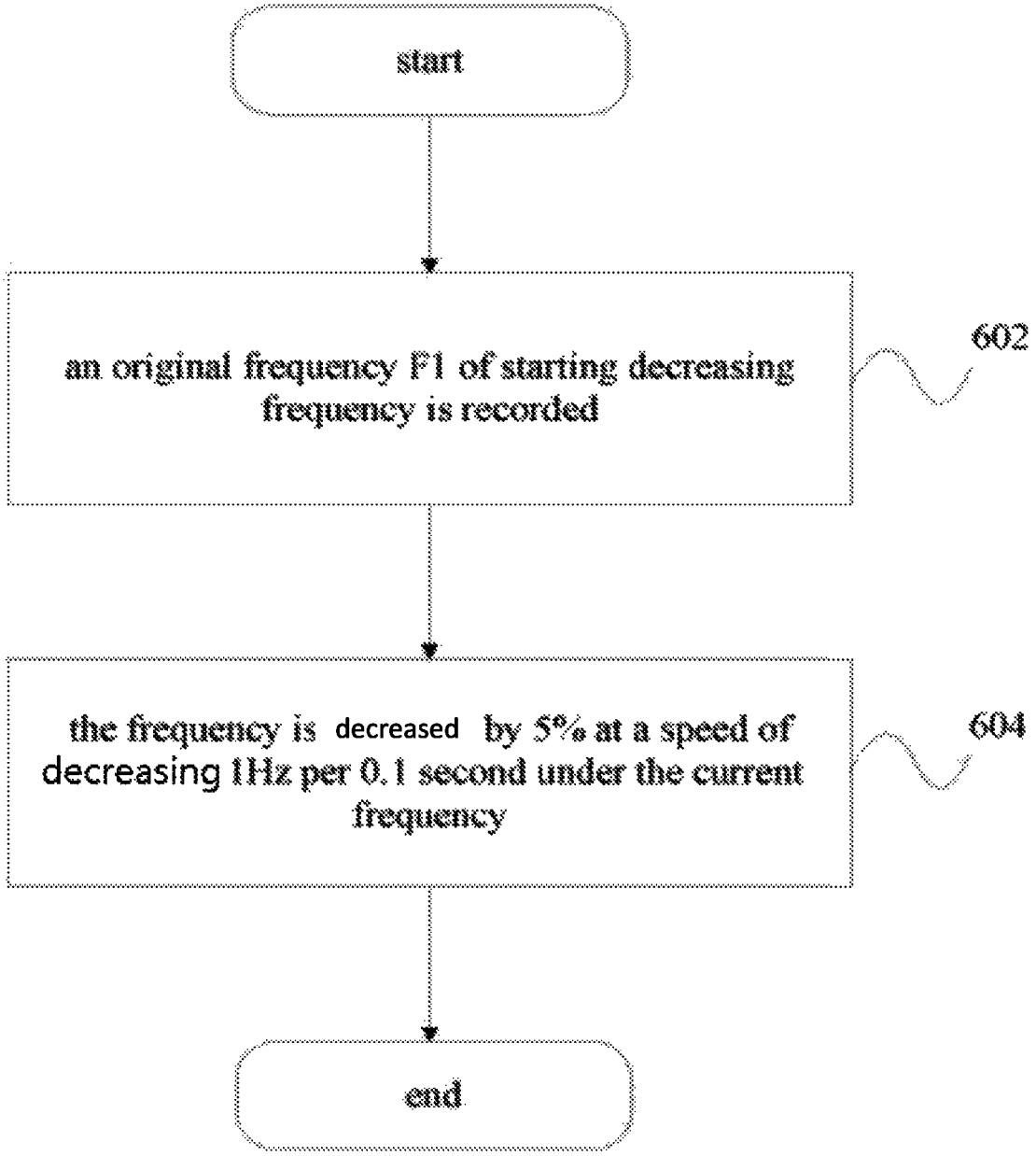
FIG. 6 is a detailed flow chart of step C of the method for controlling the solar air conditioner shown in FIG. 4.

FIG. 6 shows a detailed flow chart of step C of the exemplary embodiment of the present disclosure;

Referring to FIG. 6, the detailed flow of the step C includes:

Step 602, recording an original frequency F1 of starting decreasing the frequency.

Step 604, decreasing the operating frequency according to a first decreasing speed, such as, the frequency is decreased by 5% at a speed of decreasing 1 Hz per 0.1 second under the current frequency.

Figure 7:
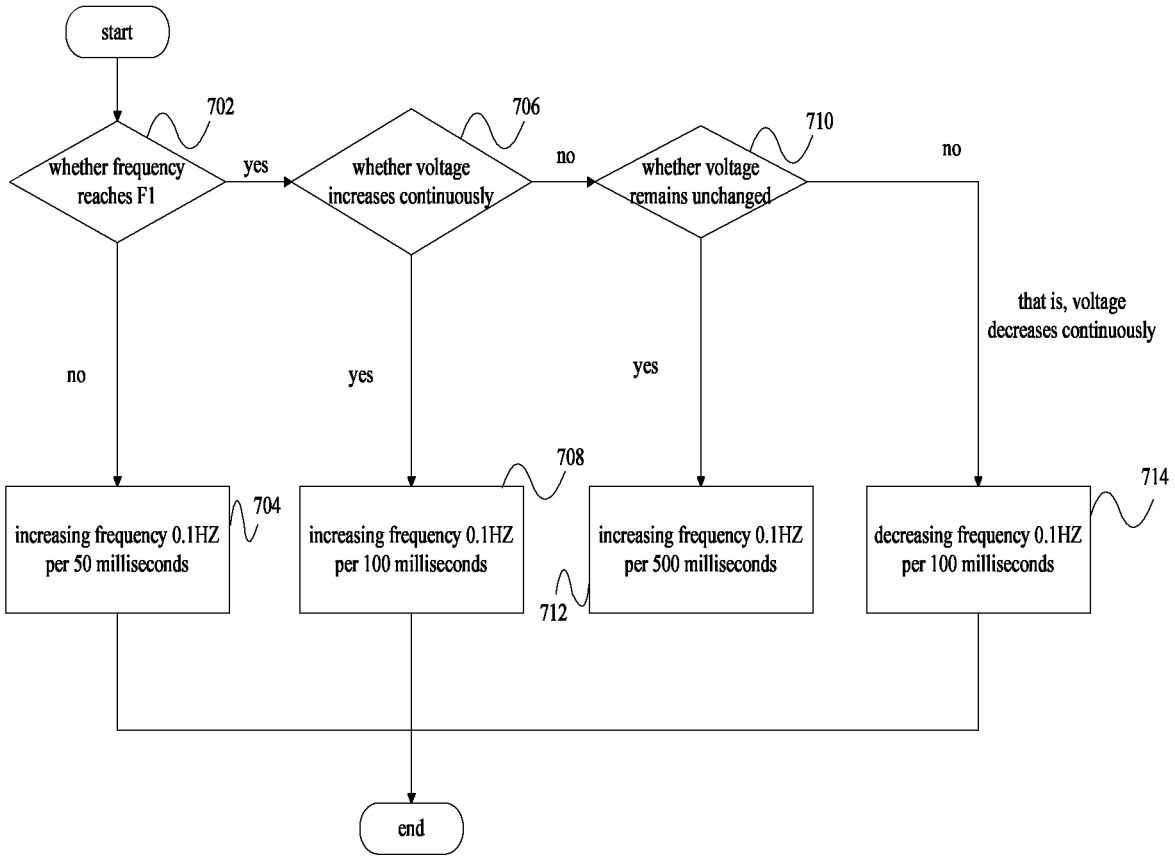
FIG. 7 is a detailed flow chart of step B of the method for controlling the solar air conditioner shown in FIG. 4.

FIG. 7 shows a detailed flow chart of step B of the exemplary embodiment of the present disclosure;

Referring to FIG. 7, the detailed flow of the step B includes:

Step 702, when the changing situation of the direct voltage outputted by the inverter of the solar air conditioner is that the outputted direct voltage is always higher than the preset voltage value, judging whether the operating frequency of the compressor reaches a frequency F1 needed to be decreased when the direct voltage is lower than the preset voltage value, when the judgement is no, go to step 704, when the judgement is yes, go to step 706.

Step 704, increasing the operating frequency at the second increasing speed, such as, the operating frequency of the compressor is increased at a speed of increasing 0.1 HZ per 50 milliseconds.

Step 706, judging whether the direct voltage continuously increases, when the judgement is yes, go to step 708, when the judgement is no, go to step 710.

Step 708, increasing the operating frequency at the third increasing speed, such as, the operating frequency is increased at a speed of increasing 0.1 HZ per 100 milliseconds.

Step 710, judging whether the direct voltage outputted remains unchanged, when the judgement is yes, go to step 712, when the judgement is no, that is, the voltage is in a continuously decreasing state, go to step 714.

Step 712, increasing the operating frequency at the fourth increasing speed, such as, the operating frequency is increased at a speed of increasing 0.1 HZ per 500 milliseconds.

Step 714, decreasing the operating frequency at the second decreasing speed, such as, the operating frequency is decreased at a speed of decreasing 0.1 HZ in 100 milliseconds.

Figure 8:
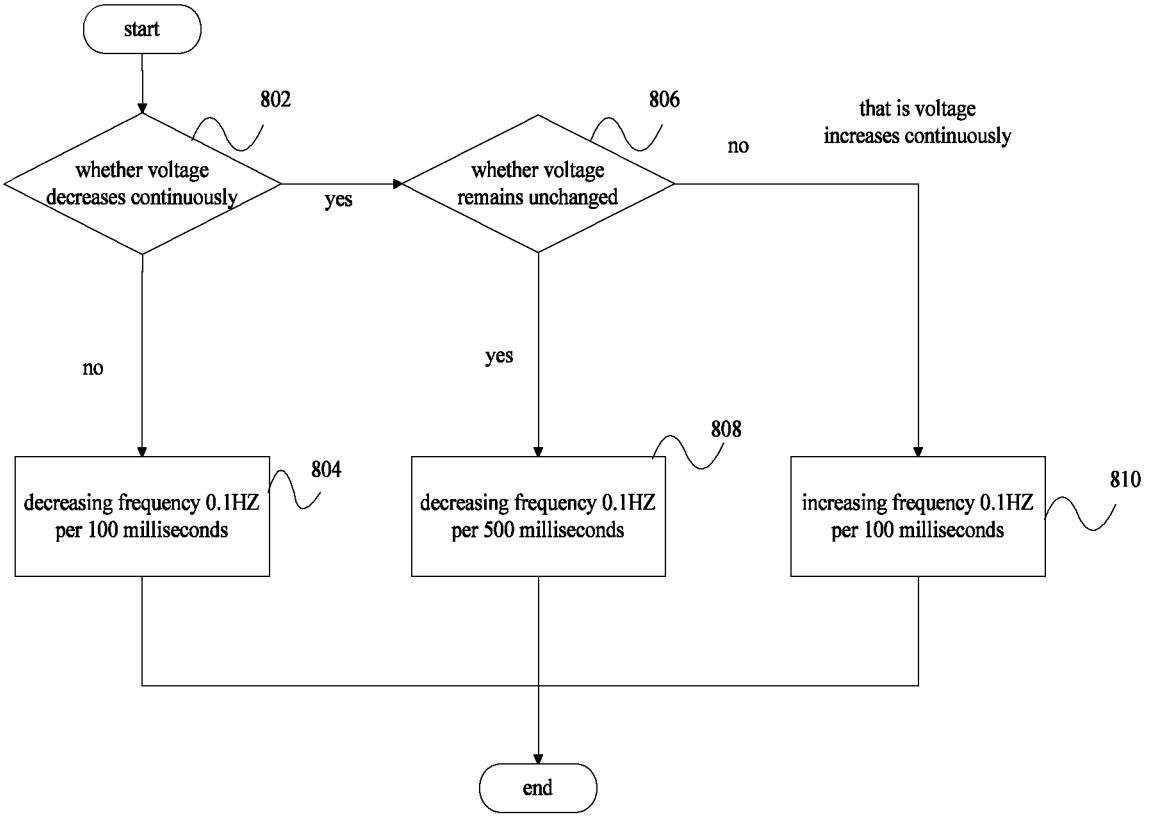
FIG. 8 is a detailed flow chart of step D of the method for controlling the solar air conditioner shown in FIG. 4.

FIG. 8 shows a detailed flow chart of step D of the exemplary embodiment of the present disclosure.

Referring to FIG. 8, the detailed flow of the step D includes:

Step 802, judging whether the outputted direct voltage continuously decreases, when the judgement is yes, go to step 804, when the judgement is no, go to step 806.

Step 804, decreasing the operating frequency at the third decreasing speed, such as, the operating frequency of the compressor is decreased at a speed of decreasing 0.1 HZ in 100 milliseconds under the current frequency.

Step 806, judging whether the outputted direct voltage remains unchanged, when the judgement is yes, go to step 808, when the judgement is no, go to step 810.

Step 808, decreasing the operating frequency at the fourth decreasing speed, such as, the operating frequency of the compressor is decreased at a speed of decreasing 0.1 HZ in 500 milliseconds under the current frequency.

Step 810, judging whether the outputted direct voltage increases continuously, the operating frequency is increased at the fifth decreasing speed, such as, the operating frequency of the compressor is increased at a speed of increasing 0.1 HZ per 100 milliseconds under the current frequency.

The technology solutions of the present disclosure are described specifically with the drawings, the solar energy can be maximumly used through the technology solutions of the present disclosure, the structure is simple, the operation is easy, and the cost is saved.

In the present disclosure, term "first", "second", "third", "fourth", "fifth" can only be used to describe the aim, and cannot be understood as indicating or suggesting relative importance.

Above is only the preferred embodiments of the present disclosure, and the present disclosure is not limited to such embodiments, the present disclosure can have different changes and replacements for the ordinary skill in the art. The present disclosure is intended to cover all modifications, equivalent replacements and improvements falling within the spirit and scope of the disclosure defined in the appended claims.

What is claimed is:

1. A method for controlling a solar air conditioner, comprising:

receiving an enabling command to enable the solar air conditioner to enter into an energy-saving control mode;

disconnecting the solar air conditioner from a utility grid;

powering the solar air conditioner by an output of an inverter coupled to a solar cell, the inverter being configured to increase a cell DC voltage of an output of the solar cell to generate the output of inverter;

detecting, through a controller of the solar air conditioner, a change of an inverter DC voltage of the output of the inverter;

and changing, through the controller, an operating frequency of a compressor of the solar air conditioner according to at least the change of the inverter DC voltage.

2. The method according to claim 1, wherein detecting the change of the inverter DC voltage and changing the operating frequency of the compressor comprise at least one of:

determining that the inverter DC voltage is increasing, and increasing the operating frequency of the compressor; or determining that the inverter DC voltage is decreasing, and decreasing the operating frequency of the compressor.

3. The method according to claim 1, wherein detecting the change of the inverter DC voltage and changing the operating frequency of the compressor comprise at least one of:

determining that the inverter DC voltage has increased from lower than a reference DC voltage value to higher than the reference DC voltage value, and increasing the operating frequency of the compressor;

determining that the inverter DC voltage has decreased from higher than the reference DC voltage value to lower than the reference DC voltage value, and decreasing the operating frequency of the compressor;

determining that the inverter DC voltage remains higher than the reference DC voltage value, and determining that the operating frequency of the compressor is lower than a threshold frequency and speeding up an increasing of the operating frequency of the compressor, wherein the threshold frequency is an upper limit of the operating frequency of the compressor when being powered by the inverter DC voltage that is lower than the reference DC voltage;

determining that the inverter DC voltage remains higher than the reference DC voltage value and continuously increases, and determining that the operating frequency is equal to or higher than the threshold frequency and increasing the operating frequency of the compressor;

determining that the inverter DC voltage is higher than the reference DC voltage value and remains unchanged, and determining that the operating frequency is equal to or higher than the threshold frequency and slowing down the increasing of the operating frequency of the compressor;

determining that the inverter DC voltage is higher than the reference DC voltage value and continuously decreases, and determining that the operating frequency is equal to or higher than the threshold frequency and decreasing the operating frequency of the compressor; or determining that the inverter DC voltage remains lower than the reference DC voltage value, and decreasing the operating frequency of the compressor.

4. The method according to claim 1, further comprising:

receiving a disabling command; and controlling, through the controller, the solar air conditioner to terminate the energy-saving mode according to the disabling command.

5. The method according to claim 4, further comprising:

connecting the solar air conditioner to the utility grid via an AC-DC rectifier; and performing at least one of:

determining that the inverter DC voltage is higher than a rectifier DC voltage of an output of the AC-DC rectifier, and powering the solar air conditioner by the output of the inverter; or determining that the inverter DC voltage is lower than or equal to the rectifier DC voltage, and powering the solar air conditioner by the output of the AC-DC rectifier.

6. A device for controlling a solar air conditioner, comprising one or more processors and a non-transitory program storage medium coupled to the one or more processors and storing program codes that, when executed by the one or more processors, cause the one or more processors to:

receive an enabling command to enable the solar air conditioner to enter into an energy-saving mode;

disconnect the solar air conditioner from a utility grid;

power the solar air conditioner by an output of an inverter coupled to a solar cell, the inverter being configured to increase a cell DC voltage of an output of the solar cell to generate the output of inverter;

detect a change of an inverter DC voltage of the output of the inverter;

and change an operating frequency of a compressor of the solar air conditioner according to at least the change of the inverter DC voltage.

7. The device according to claim 6, wherein the executed program codes further cause the one or more processors to perform at least one of:

determining that the inverter DC voltage is increasing, and increasing the operating frequency of the compressor; or determining that the inverter DC voltage is decreasing, and decreasing the operating frequency of the compressor.

8. The device according to claim 6, wherein the executed program codes further cause the one or more processors to perform at least one of:

determining that the inverter DC voltage has increased from lower than a reference DC voltage value to higher than the reference DC voltage value, and increasing the operating frequency of the compressor;

determining that the inverter DC voltage has decreased from higher than the reference DC voltage value to lower than the reference DC voltage value, and decreasing the operating frequency of the compressor;

determining that the inverter DC voltage remains higher than the reference DC voltage value, and determining that the operating frequency of the compressor is lower than a threshold frequency and speeding up an increasing of the operating frequency of the compressor, wherein the threshold frequency is an upper limit of the operating frequency of the compressor when being powered by the inverter DC voltage that is lower than the reference DC voltage;

determining that the inverter DC voltage remains higher than the reference DC voltage value and continuously increases, and determining that the operating frequency is equal to or higher than the threshold frequency and increasing the operating frequency of the compressor;

determining that the inverter DC voltage is higher than the reference DC voltage value and remains unchanged, and determining that the operating frequency is equal to or higher than the threshold frequency and slowing down the increasing of the operating frequency of the compressor;

determining that the inverter DC voltage is higher than the reference DC voltage value and continuously decreases, and determining that the operating frequency is equal to or higher than the threshold frequency and decreasing the operating frequency of the compressor; or determining that the inverter DC voltage remains lower than the reference DC voltage value, and decreasing the operating frequency of the compressor.

9. The device according to claim 6, wherein the executed program codes further cause the one or more processors to:

receive a disabling command; and control the solar air conditioner to terminate the energy-saving mode according to the disabling command.

10. The device according to claim 9, wherein the executed program codes further cause the one or more processors to:

connect the solar air conditioner to the utility grid via an AC-DC rectifier; and perform at least one of:

determining that the inverter DC voltage is higher than a rectifier DC voltage of an output of the AC-DC rectifier, and powering the solar air conditioner by the output of the inverter; or determining that the inverter DC voltage is lower than or equal to the rectifier DC voltage, and powering the solar air conditioner by the output of the AC-DC rectifier.

11. A solar air conditioner, comprising:

a solar cell;

a direct current inverter air conditioner; and a solar power controller connected between the solar cell and the direct current inverter air conditioner, the solar power controller comprising an inverter; and a control device for controlling the solar air conditioner, the control device being configured to:

receive an enabling command to enable the solar air conditioner to enter into an energy-saving mode;

disconnect the solar air conditioner from a utility grid;

power the solar air conditioner by an output of an inverter coupled to a solar cell, the inverter being configured to increase a cell DC voltage of an output of the solar cell to generate the output of inverter;

detect a change of an inverter DC voltage of the output of the inverter;

and change an operating frequency of a compressor of the solar air conditioner according to at least the change of the inverter DC voltage.

12. The solar air conditioner according to claim 11, wherein the control device is further configured to perform at least one of:

determining that the inverter DC voltage is increasing, and increasing the operating frequency of the compressor; or determining that the inverter DC voltage is decreasing, and decreasing the operating frequency of the compressor.

13. The solar air conditioner according to claim 11, wherein the control device is further configured to perform at least one of:

determining that the inverter DC voltage has increased from lower than a reference DC voltage value to higher than the reference DC voltage value, and increasing the operating frequency of the compressor;

determining that the inverter DC voltage has decreased from from higher than the reference DC voltage value to lower than the reference DC voltage value, and decreasing the operating frequency of the compressor;

determining that the inverter DC voltage remains higher than the reference DC voltage value, and determining that the operating frequency of the compressor is lower than a threshold frequency and speeding up an increasing of the operating frequency of the compressor, wherein the threshold frequency is an upper limit of the operating frequency of the compressor when being powered by the inverter DC voltage that is lower than the reference DC voltage;

determining that the inverter DC voltage remains higher than the reference DC voltage value and continuously increases, and determining that the operating frequency is equal to or higher than the threshold frequency and increasing the operating frequency of the compressor;

determining that the inverter DC voltage is higher than the reference DC voltage value and remains unchanged, and determining that the operating frequency is equal to or higher than the threshold frequency and slowing down the increasing of the operating frequency of the compressor;

determining that the inverter DC voltage is higher than the reference DC voltage value and continuously decreases, and determining that the operating frequency is equal to or higher than the threshold frequency and decreasing the operating frequency of the compressor; or determining that the inverter DC voltage remains lower than the reference DC voltage value, and decreasing the operating frequency of the compressor.

14. The solar air conditioner according to claim 11, wherein the control device is further configured to:

receive a disabling command; and control the solar air conditioner to terminate the energy-saving mode according to the disabling command.

15. The solar air conditioner according to claim 14, wherein the control device is further configured to:

connect the solar air conditioner to the utility grid via an AC-DC rectifier; and perform at least one of:

determining that the inverter DC voltage is higher than a rectifier DC voltage of an output of the AC-DC rectifier, and powering the solar air conditioner by the output of the inverter; or determining that the inverter DC voltage is lower than or equal to the rectifier DC voltage, and powering the solar air conditioner by the output of the AC-DC rectifier.

16. The method according to claim 1, wherein detecting the change of the inverter DC voltage and changing the operating frequency of the compressor comprise determining that the inverter DC voltage remains lower than a reference DC voltage value, and decreasing the operating frequency of the compressor;

the method further comprising performing at least one of:

determining that, while the operating frequency of the compressor is decreasing, the inverter DC voltage keeps increasing and is lower than the reference DC voltage value, and increasing the operating frequency of the compressor; or determining that, while the operating frequency of the compressor is decreasing, the inverter DC voltage decreases or is not lower than the reference DC voltage value, and continuing to decrease the operating frequency of the compressor.

17. The device according to claim 6, wherein the executed program codes further cause the one or more processors to:

determine that the inverter DC voltage remains lower than a reference DC voltage value, and decrease the operating frequency of the compressor; and perform at least one of:

determining that, while the operating frequency of the compressor is decreasing, the inverter DC voltage keeps increasing and is lower than the reference DC voltage value, and increasing the operating frequency of the compressor; or determining that, while the operating frequency of the compressor is decreasing, the inverter DC voltage decreases or is not lower than the reference DC voltage value, and continuing to decrease the operating frequency of the compressor.

18. The solar air conditioner according to claim 11, wherein the control device is further configured to:

determine that the inverter DC voltage remains lower than a reference DC voltage value, and decrease the operating frequency of the compressor; and perform at least one of:

determining that, while the operating frequency of the compressor is decreasing, the inverter DC voltage keeps increasing and is lower than the reference DC voltage value, and increasing the operating frequency of the compressor; or determining that, while the operating frequency of the compressor is decreasing, the inverter DC voltage decreases or is not lower than the reference DC voltage value, and continuing to decrease the operating frequency of the compressor.

* * * * *